US007807028B2

(12) United States Patent
Webb

(10) Patent No.: US 7,807,028 B2
(45) Date of Patent: Oct. 5, 2010

(54) STAINLESS STEEL ELECTROLYTIC PLATES

(75) Inventor: Wayne Keith Webb, Railway Estate (AU)

(73) Assignee: Xstrata Queensland Limited, Brisbane, Queensland ( * ) Notice: Subject to any disclaimer, the term of this patent is extended or adjusted under 35 U.S.C. 154(b) by 555 days.

(21) Appl. No.: 11/281,686

(22) Filed: Nov. 16, 2005

(65) Prior Publication Data

US 2006/0201586 A1 Sep. 14, 2006

(30) Foreign Application Priority Data

Mar. 9, 2005 (AU) ..... 2005901127

(51) Int. Cl.
*C25D 1/20* (2006.01)
*C25B 11/02* (2006.01)
*C25B 11/04* (2006.01)

(52) U.S. Cl. ..... 204/281; 204/286.1; 204/288; 204/289

(58) Field of Classification Search ..... 204/281, 204/284, 286.1, 288, 289
See application file for complete search history.

(56) References Cited

U.S. PATENT DOCUMENTS

| | | | | |
|---|---|---|---|---|
| 3,883,411 | A | 5/1975 | Gendron et al. | |
| 4,082,641 | A | 4/1978 | Parkinson et al. | |
| 4,186,074 | A | 1/1980 | Perry | |
| 4,528,046 | A * | 7/1985 | Yamamoto et al. | 148/609 |
| 4,612,069 | A * | 9/1986 | Rainger et al. | 148/325 |
| 4,715,939 | A * | 12/1987 | Ball et al. | 204/528 |
| 5,254,225 | A | 10/1993 | Gallup | |
| 6,254,744 | B1 * | 7/2001 | Larsson | 204/286.1 |
| 6,306,341 | B1 * | 10/2001 | Yokota et al. | 420/35 |
| 6,485,621 | B2 * | 11/2002 | Del Rincon et al. | 204/281 |
| 6,623,569 | B2 * | 9/2003 | Dunn et al. | 148/325 |
| 6,635,159 | B1 * | 10/2003 | Marttila | 204/297.01 |
| 6,749,697 | B2 * | 6/2004 | Bergstrom et al. | 148/325 |
| 7,014,036 | B2 * | 3/2006 | Robinson et al. | 198/678.1 |
| 2004/0050463 | A1 * | 3/2004 | Jung et al. | 148/608 |
| 2007/0031608 | A1 * | 2/2007 | Webb et al. | 427/498 |

FOREIGN PATENT DOCUMENTS

| | | |
|---|---|---|
| JP | 11323565 | 11/1999 |
| WO | WO 01/88224 | 11/2001 |
| WO | 02070787 | 9/2002 |
| WO | WO 03/020995 | 3/2003 |

OTHER PUBLICATIONS

International Search Report—PCT/AU2006/000312 dated Apr. 10, 2006.
International Preliminary Report on Patentability PCT/AU2006/000312 dated Feb. 7, 2007.
U.S. Appl. No. 11/908,289, filed Sep. 10, 2007, Webb.
Urda-Kiel, M. et al. 'Nucleation and initial stages of growth of copper electrodeposited on anodized 304 stainless steel', Proceedings of the Copper 99-Cobre ii International Conference, 4th, Phoenix, Editor(s): Dutrizac, John E.; Ji, Jinxing; Ramachandran, V. , Oct. 10-13, 1999, vol. 3, pp. 511-527. (abstract) Database Ca [online]. Retrieved from STN Database accession No. 132:270948. Retrieved on Nov. 28, 2008.
Supplementary European Search Report/Search Opinion in PCT/AU2006/000312 dated Jan. 13, 2009.
English Language Summary of Office Action mailed Aug. 8, 2009 from co-pending Chinese Application No. 200680014666.6.

* cited by examiner

*Primary Examiner*—Bruce F Bell
(74) *Attorney, Agent, or Firm*—Fish & Richardson P.C.

(57) ABSTRACT

There is provided a substantially permanent stainless steel cathode plate suitable for use in electrorefining of metal cathodes, the cathode being composed of a low-nickel duplex steel or a lower grade "304" steel, wherein operational adherence of an electrodeposition thereon is enabled by altering various qualities of the cathode surface.

There is also provided a method of producing the above duplex or Grade 304 cathode plates, such that the desired operational adherence of the deposit upon the plate is not so strong as to prevent the deposit being removed during subsequent handling.

22 Claims, 1 Drawing Sheet

STAINLESS STEEL ELECTROLYTIC PLATES

RELATED APPLICATIONS

This application claims priority from Australian Provisional Patent Application No. 2005901127, filed 9 Mar. 2005, which is incorporated herein by reference.

FIELD OF THE INVENTION

The present invention relates to electrolytic plates and in particular to substantially permanent cathode plates suitable for use in the electrolytic recovery of metals.

The invention has been developed primarily as a substantially permanent stainless steel cathode plate suitable for use in the electrowinning of copper cathodes. The operational adherence of an electrodeposition is enhanced by the surface finish characteristics of the cathode; this development will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Electrorefining of copper includes electrolytically dissolving copper from impure anodes of about 99.7% Cu, and then selectively plating the dissolved copper in pure form onto a cathode. This reaction occurs in a cell containing an electrolyte, which is substantially a mixture of copper sulfate and sulfuric acid.

There are various processes and apparatus for the electrorefining of metal. For the electrowinning of copper, the current industry best practice is toward the production and use of "permanent" stainless steel cathode plates. Such practice is largely based on the original work (and patents) of Jim Perry, et al. of Mount Isa Mines, Queensland, Australia. Such techniques are generically known throughout the industry as ISA PROCESS® technology.

ISA PROCESS® technology (also ISA PROCESS 2000™) is a trade mark of Mount Isa Mines Limited and has been licensed in Australia, Austria, Belgium, Canada, Chile, China, Cyprus, Egypt, England, Germany, India, Indonesia, Iran, Japan, Myanmar, Mexico, Peru, Russia, South Africa, Spain, Sweden, Thailand and USA.

In this process, stainless steel cathode mother plates are immersed in an electrolytic bath with copper anodes. Application of an electric current causes the unrefined base metal from the anode to dissolve into the electrolytic bath and subsequently deposit in a refined form on a cathode blade of the mother plate. The electrolytically deposited copper is then stripped from the blade by first flexing the cathode plate to cause at least part of the copper deposit to separate therefrom, and then wedge stripping or gas blasting the remainder of the copper from the blade.

Such stripping is performed by use of knife-like blades or knife-edge wedges inserted between the steel sheet and the deposited copper at the upper edge of the copper. Alternatively, stripping may be performed by automatically by passing the copper laden cathodes through a hammering station in which the deposited copper is smartly rapped near its upper edge from both sides. This loosens the copper upper edge and stripping is then finished by directing one or more streams of air into the tiny space between the steel and the loosened upper edge of the copper. However, stripping is more preferably effected by the flexion apparatus developed by the Applicants and patented as Australian Patent No. AU 712,612, or by the related method (U.S. Pat. No. 4,840,710).

The cathode mother plate generally consists of a stainless steel blade, and a hanger bar connected to the top edge of the blade to hold and support the cathode in the electrolytic bath.

The ISA PROCESS® employs a system of multiple cells, arranged in series to form practical sections. In the cells, the electrodes, anodic copper and cathodes are connected in parallel.

As an alternative to the ISA PROCESS®, another methodology is the use of starter sheets of higher purity copper, as the cathode substrate upon which the copper is electrodeposited. These starter sheets are produced in special electrolytic cells by a 24-hour electrodeposition of copper onto either hard-rolled copper or titanium blanks.

Preparation of the starter sheet includes washing, straightening and stiffening of the sheet. The sheets are then suspended from rolled copper hanger bars by attached loops of copper strips.

The fundamental difference between the ISA PROCESS® and the conventional starter sheet technology is that the ISA PROCESS® uses a 'permanent' reusable cathode blank instead of a non-reusable copper starter sheet.

The key element of the technology is the proprietary design of the ISA PROCESS® cathode plate. The plate itself is fabricated from "316L" stainless steel, welded to a stainless steel rectangular hollow section hanger bar. The hanger bar is encapsulated with electroplated copper for electrical conductivity and corrosion resistance.

Stainless steel is an iron-based metal that contains very low carbon levels (compared to mild steel) and various levels of chromium. Chromium combines with oxygen to form an adherent surface film that resists oxidation. The 316L stainless steel of the ISA PROCESS® cathode plate has an approximate composition of: <0.03% carbon, 16-18.5% chromium, 10-14% nickel, 2-3% molybdenum, <2% manganese, <1% silicon, <0.045% phosphorus, <0.03% sulfur and the balance of iron.

The austenitic 316L is the standard molybdenum-bearing grade. The molybdenum gives 316L excellent overall corrosion resistant properties, particularly higher resistance to pitting and crevice corrosion in acidic environments.

However, selection of the appropriate steel does not, of itself, ensure success. The desired surface adherence characteristics of a cathode plate are that it provides a sufficient tenacity of attachment between the steel sheet and the copper deposited upon it to prevent the copper from peeling or slumping from the steel on its own accord.

To this end, the 316L stainless steel is afforded the "2B" surface finish. The 2B finish is intermediate bright and dull, being a silvery-grey, semi-bright surface produced by cold rolling, softening and descaling, and then final rolling lightly with polished rolls. The result is a semi-bright grey surface that is termed "skinpass-rolled" or "2B" ("B"=bright) and has a surface roughness ($R_a$) index of between 0.1 and 0.5 μm. 2B steel is often used for process equipment within the food industry when a surface that is easy to keep clean is required.

The smoothness and reflectivity of the surface improves as the material is rolled to thinner and thinner sizes. Any annealing which needs to be done in order to effect the required reduction in gauge, and the final anneal, is effected in a very closely controlled inert atmosphere. Therefore, substantially no oxidation or scaling of the surface occurs and there is no need for additional pickling and passivating.

As used in the ISA PROCESS®, the 2B-finished 316L steel blade is 3.25 mm thick, which is welded to a hollow stainless steel section hanger bar (International Patent Publication number WO 03/062497; U.S. Patent Publication No. 2005126906). To improve electrical conductivity, the hanger bar is encapsulated with a 2.5 mm thick electroplated copper coating. The vertical edges (Australian Patent No. AU 646, 450) are marked with plastic edge strips (International Patent Application number PCT/AU00/00668) to prevent the copper cathode growing around the edges. The bottom edge is masked with a thin film of wax that, whilst preventing the copper enveloping the plate, does not provide a ledge to collect falling anode slimes, which would otherwise contaminate the cathode copper.

Because the manufacture and changing of starter sheets is increasingly costly, refineries operating by these means generally operate two cathode cycles per anode cycle, viz. the starting sheet cathodes are each generally plated with metallic copper for 12 to 14 days before they are removed; a second starter sheet is then inserted between the anodes. Accordingly, the anode cycle is generally of the order of 24 to 28 days. At the end of the cathode cycle the anode scrap is removed, washed and returned to the casting facility for melting and recasting into anodes for further electrorefining cycles.

Although the ISA PROCESS® cathode technology can accommodate variable cathode ages from 5 to 14 days, a 7 day cathode cycle is generally considered ideal, as it fits with the weekly work schedule and shorter working weeks.

The shorter cycle has numerous benefits to cathode quality. When stripped, a single cathode plate produces two single sheets of pure cathode copper. This cathode technology has led to major advancements in the electrode handling systems of copper tank houses. The stainless steel cathode plates offer precision in the straightness and verticality of the stainless steel cathode plate compared with the alternative thin starter sheet. The permanent stainless steel cathode has less chance of trapping falling slimes and other impurities in the cathode deposit during electrolysis. In short, the use of permanent stainless steel cathodes permits process efficiencies otherwise unobtainable employing starter sheets.

Moreover, the use of a stainless steel cathode plate improves current efficiency as fewer short circuits occur and hence less copper nodulations are formed. Cathode quality was also improved by the elimination of starter sheet loops.

Cathode chemical quality is exceedingly important with ever more stringent demands (exceeding LME Grade A) being placed on copper rod producers by fine wire drawers. Such quality demands must necessarily start at the copper production source—the cathode copper refineries themselves.

Notwithstanding that the major benefits of the ISA PROCESS® have been to the refiners, tangible secondary benefits have accrued for the end user, who obtains a more consistent, higher quality product. Refining intensity was greatly increased by the benefits of the permanent stainless steel cathode. The inter-electrode gap between the anode/cathode pair could be reduced, thereby increasing the active area for electrolysis per unit length of cell.

Accordingly, the electrical current density for electrolysis may be increased, and today, ISA PROCESS® refineries are operating at around 330 $A/m^2$, whereas conventional starter sheet refineries typically operate at around 240 $A/m^2$.

In-process copper inventory is an important consideration in a refinery operation. In combination, the various ISA PROCESS® efficiencies alluded to above may reduce the in-process copper by the order of 12%—a greatly significant result.

It is an object of the present invention to overcome or ameliorate at least one of the disadvantages of the prior art, or to provide a useful alternative.

It is an object of the invention in a preferred form to provide a substantially permanent duplex and/or Grade 304 stainless steel cathode plate suitable for use in electrorefining and/or electrowinning of copper cathodes.

It is a further object of the present invention in yet another preferred form, to provide a method of producing a duplex steel electrolytic plate suitable for the electrodeposition and adherence of a metal thereupon, and a method of producing a Grade 304 steel electrolytic plate suitable for the electrodeposition and adherence of a metal thereupon.

DISCLOSURE OF THE INVENTION

According to a first aspect of the present invention there is provided an electrolytic plate suitable as a substrate for the electrodeposition of a metal, said plate being at least partially comprised of duplex stainless steel.

Preferably, the duplex stainless steel is a low-nickel and/or low-molybdenum steel relative to 316L stainless steel. Preferably, the duplex steel is characterised substantially by a composition including approximately: 22-26% Cr; 4-7% Ni; 0-3% Mo; and 0.1-0.3% N. Alternatively, the duplex steel is characterised substantially by a composition including approximately: 1.5% Ni; 21.5% Cr; 5% Mn; 0.2% N.

In an embodiment, the electrolytic plate is suitable for use as a starter sheet cathode blank.

According to a second aspect of the present invention there is provide an electrolytic plate suitable as a substrate for the electrodeposition of a metal, said plate being at least partially comprised of "Grade 304" steel.

In an embodiment, the electrolytic plate is substantially permanent and/or reusable, e.g. a cathode mother plate.

Preferably, the Grade 304 steel is characterised substantially by a composition including approximately: <0.8% C; 17.5-20% Cr; 8-11% Ni; <2% Mn; <1% Si; <0.045% P; <0.03% S; remainder Fe.

In another embodiment, the Grade 304 stainless steel is prepared with a 2B finish.

In embodiments of the first and second aspects, the surface/s of the electrolytic plate are modified so as to impart upon the plate predetermined adhesion characteristics. The term "predetermined adhesion characteristics" should be taken to mean that a surface upon which the electrodeposition of metal is sought has had its surface roughness modified to produce the adhesion necessary to allow operational adherence of an electrodeposit and subsequent handling thereof, the adherence being insufficiently strong as to prevent the mechanical separation of the electrodeposit from the modified surface.

In a preferred embodiment, the electrolytic plate is a cathode and the electrodeposition is of copper, either by electrorefining or electrowinning.

In another embodiment, a buffed surface finish imparts upon the plate predetermined adhesion characteristics. Preferably, the buffed surface finish is a plating surface that has had its surface roughness modified to produce the adhesion necessary to allow operational adherence of an electrodeposited metal and subsequent handling thereof, yet insufficient to prevent the mechanical separation of the electrodeposited metal from the modified surface.

In an embodiment, the buffed finish is defined by a surface roughness $R_a$ typically within the approximate range 0.6 to 2.5 μm.

In a particularly preferred embodiment, the buffed finish is defined by a surface roughness $R_a$ typically within the approximate range 0.6 to 1.2 μm.

Preferably, the buffed finish may be applied by devices such as linishing tools, angle grinders, electric or air driven sanding machines, or a combination thereof.

In another embodiment, one or more cavities are formed into the surface of the plate, thereby to impart upon the plate predetermined adhesion characteristics.

In an embodiment, at least some of the cavities extend fully through the depth of the plate, whereas in an alternative embodiment, at least some of the cavities extend only partially through the depth of the plate.

In another embodiment, the cavities are spaced from the upper deposition line of the electrodeposited metal such that deposited metal above the uppermost the cavity is relatively easy to remove and deposited metal at or below the level of the uppermost cavity is relatively difficult to remove.

Preferably, the cavities are located substantially 15 to 20 cm from the top of the plate, thereby to facilitate the formation of a relatively easily removed upper metal portion and a relatively difficulty removed lower metal portion.

In an embodiment, the electrodeposited metal is removable by a flexion apparatus first wedging between the upper metal portion and the plate.

In a further embodiment, one or more groove portions are formed into the surface of the plate, thereby to impart upon the plate predetermined adhesion characteristics. The groove portions may be substantially of any shape or orientation upon the surface of the plate, but are preferably not horizontal due to the V-groove limitation allied with the fact that the separation apparatus strips the electrodeposited metal from top-to-bottom.

In another embodiment, one or more ledge portions are located upon the surface of the plate, thereby to impart upon the plate predetermined adhesion characteristics. The ledge portions may be substantially of any shape or orientation upon the surface of the plate. Substantially horizontal ledge portion/s provide greater operational adherence, with the attendant trade-off that more anode sludge may accumulate upon them, thereby compromising the purity of the electrodeposition.

In another embodiment, the surface of the plate is etched, thereby to impart upon the plate predetermined adhesion characteristics. Preferably, the etching is performed by electrochemical means.

In further embodiments, the plate includes cropped corner technology and/or V-groove technology, thereby to facilitate stripping of the electrodeposit thereon.

According to a third aspect of the present invention there is provided a method of electrodepositing a metal upon an electrolytic plate according to the first aspect and/or the second aspect.

According to a fourth aspect of the present invention there is provided a method of producing a duplex steel electrolytic plate suitable for the electrodeposition and adherence of metal thereupon, said method including:

modifying the surface of a duplex steel plate to obtain a plating surface with modified surface roughness to produce the adhesion necessary to allow operational adherence of an electrolytic metal deposit and subsequent handling thereof, said adherence being insufficiently strong to prevent the mechanical separation of said electrodeposited metal from said modified surface.

According to a fifth aspect of the present invention there is provided a duplex stainless steel electrolytic plate when formed by a method according to the fourth aspect.

According to a sixth aspect of the present invention there is provided a method of producing a Grade 304 steel electrolytic plate suitable for the electrodeposition and adherence of metal thereupon, said method including:

modifying the surface of a Grade 304 steel plate to obtain a plating surface with modified surface roughness to produce the adhesion necessary to allow operational adherence of an electrolytic metal deposit and subsequent handling thereof, said adherence being insufficiently strong to prevent the mechanical separation of said electrodeposited metal from said modified surface.

According to a seventh aspect of the present invention there is provided a Grade 304 steel electrolytic plate when formed by a method according to the sixth aspect.

Despite the advantages alluded to above, the unpredictable (and presently rapidly-rising) price of both nickel and molybdenum has placed increasing pressure on the economic use of 316L stainless steel as an industry standard cathode plate.

The reusable cathode technology presently employed suffers from the disadvantage of the prohibitive cost of the raw materials associated with it. Accordingly, the scope for use of reusable cathodes is narrow. It has surprisingly been found that the combination of new materials and a managed surface finish may permit savings in both the quantity and cost of the raw materials utilised in cathode manufacture. The cost reductions realised may, in turn, increase the scope of the reusable cathode market and there may be the potential to extend this into the electrodeposition of other metals.

An opportunity exists for the development of a viable alternative "permanent" cathode plate. Unfortunately, such a material has not been readily forthcoming, due at least in part to the dual problems of providing a cathode plate that simultaneously exhibits:

1. Sufficient corrosion-resistance in the strongly acidic $H_2SO_4/CuSO_4$ medium; and
2. Sufficient operational contact adherence of the copper deposit to allow safe transport of the plated electrodes to the electrode handling machines, wherein the adherence must permit the ready separation by physical means of the deposit without chemical or physical damage to cathode blade.

Accordingly, there is a need for alternative materials displaying the above characteristics, so as to produce a more economically viable cathode plate. The use of lower-nickel austenitic stainless steels has been considered, as has the use of non-austenitic steels. However, the use of low-nickel duplex steels was considered a viable alternative cathode plate, should it be available in a suitable finish.

The most widely used type of stainless steel is 'Austenitic' stainless steel. A "fully austenitic" steel structure has a nickel content of at least of 7%, which gives it ductility, a large scale of service temperature, non-magnetic properties and good weldability. The range of applications of austenitic stainless steel includes housewares, containers, industrial piping and vessels, architectural facades and constructional structures.

'Ferritic' stainless steel has properties similar to mild steel but with better corrosion resistance. The most common of these steels include between 12 and 17% chromium, with 12% used mostly in structural applications and 17% in housewares, boilers, washing machines and indoor architecture.

'Duplex' steel has a two-phase structure of almost equal proportions austenite and ferrite. The duplex structure delivers both strength and ductility. Duplex steels are mostly used in petrochemical, paper, pulp and shipbuilding industries.

Various combinations of alloying elements may be used to achieve this ferritic/austenitic state. The composition of the most common duplex steels is within the limits: 22-26% Cr; 4-7% Ni; 0-3% Mo; with a small amount of nitrogen (0.1-0.3%) to stabilise the austenite. One suitable commercial duplex stainless steel contains approximately 1.5% Ni; 21.5% Cr; 5% Mn; and 0.2% N.

As mentioned above, the generally accepted wisdom within the electrorefining industry is that the 2B finish is necessary upon a cathode plate if an electrodeposited metal is to adhere sufficiently to it. Although some of the available duplex stainless steels exhibit corrosion resistance consistent with the requirements of the electrorefining industry, these materials are not available in a 2B finish.

As the 2B finish cannot be imparted upon duplex steel by manufacture, a viable alternative was thought to mimic its surface adhesion characteristics, viz. the production of a "2B-like" finish by buffing and/or brushing the surface of the duplex steel.

Contrary to the accepted wisdom requiring a 2B finish, the Applicants have surprisingly found that when duplex steel is used "as is" in a cathode plate for the electrowinning of copper, then operational adherence of the deposit to the plate is acceptably fast as to allow for the necessary further handling.

However, two further modifications have been developed within the scope of the present invention so as to broaden the efficacy of duplex steel cathode plates.

Firstly, a "physical lock" such as ledges, grooves and/or holes may be applied to the surface of the cathode. Ledges and/or grooves may be horizontal, vertical, diagonal or any combination thereof across one or more surfaces of the cathode. Optionally, the ledge/s an/or groove/s may be substantially horizontally disposed across the width of the foot portion of both the front and back faces of the cathode. The ledge/s and/or groove/s serve to prevent "winding off" of an electrowon copper deposit by providing a surface against which a solid deposit cannot 'slip off' under gravity. However, a substantially horizontal ledge suffers from the aforementioned problem of providing a surface upon which anode sludge may accumulate, and a substantially horizontal groove imparts a V-groove limitation upon the cathode surface.

Preferably, the groove/s are disposed substantially vertically along substantially the length of the plate. This preference stems from the normal mode of operation of the ISA PROCESS® flexion removal device, which operates from top-to-bottom. Should the grooves be placed horizontally, then the resultant V-groove limitation may cause electrodeposited metal removed from the surface to fracture about the groove.

Similarly, the placement of one or more holes upon the surface/s of the cathode plate enables the copper to plate within the holes, thus giving better adherence to the cathode. The hole/s may extend fully or partially through the depth/width of the plate, and are preferably located 15-20 cm from the top of the plate to allow for the deposition of an upper plated portion above the uppermost hole, and a lower plated portion at and below the level of the uppermost hole.

The upper plated portion will be relatively easy to remove, as its adhesion to the plate is not enhanced relative to the unperforated plate. However, the lower plated portion will be relatively difficult to remove as the greater operational adherence caused by the metal plating within one or more cavities enhances the operational adherence. Accordingly, the removal device, operating top-to-bottom upon the surface of the electrolytic plate wedges between the upper plated portion and the plate itself to better facilitate removal of the lower plated portion thereafter.

The plate is gripped and flexed in the first stage of removing the copper deposit. Preferably, a deposit formed within a hole and the adherence provided thereby is machine breakable. Accordingly, the optimum size/number/placement/depth of the holes may vary according to scale, cathode cycle length and the metal being refined.

A second means of providing better operational adherence is to electrochemically etch the surface of the cathode so as to create an etched surface to which an electrowon copper deposit may better adhere. Such electrochemical etching must, however, retain the substantial verticality of the stainless steel plate such that a substantially flat copper sheet can still be produced from it.

An obvious advantage of duplex steel cathode plates is borne out in cost. Duplex steel is generally cheaper than 316L steel. In addition, duplex steel is far stronger than 316L steel presently used in cathode plates, meaning that duplex cathode plates will foreseeably be able to be produced thinner, without compromising their essential functionality. A plate must necessarily be strong enough to undergo separatory flexion of the electrodeposit from the cathode surface. Whereas 316L cathode plates are typically of the order of 3.25 mm thickness, duplex steel is, in principle, sufficiently strong as to sustain a cathode plate of around 1 mm thickness. However, the selective placement of ledges, grooves and/or holes upon the surface/s of the cathode plate means that such plates are preferably of the order of 2.0-2.25 mm thickness. Regardless, at current prices, a 2.25 mm thick duplex stainless steel cathode represents an additional significant cost saving over the functionally equivalent 3.25 mm thick 316L cathode plate. The significance of these savings in terms of the economic efficiency of industrial scale electrorefineries should not be underestimated.

A further market for the duplex stainless steel cathode plate is as a starter sheet. Starter sheet technology has been described above, and the advantages of attaining a suitable duplex steel starter sheet are manifested both in cost and process efficiencies.

A further development within the scope of the present invention has been the use of lower-grade "304" steel as a cathode plate. Grade 304 steel has a typical composition of: <0.8% C; 17.5-20% Cr; 8-11% Ni; <2% Mn; <1% Si; <0.045% P; <0.03% S; and the balance in Fe.

Grade 304 is the most versatile and widely used stainless steel. The balanced austenitic structure of 304 enables it to be severely deep drawn without intermediate annealing, which has made this grade dominant in the manufacture of drawn stainless parts such as sinks, hollow-ware and saucepans. Grade 304 is readily brake or roll formed into a variety of components for applications in the industrial, architectural, and transportation fields. The austenitic structure also gives 304 excellent toughness.

Grade 304 steel has, however, suffered from the stigma of being thought too corrosion-susceptible to be effective as a cathode plate. It is subject to pitting and crevice corrosion in warm chloride environments; it is considered resistant to potable water with up to about 200 mg/L chlorides at ambient temperature, reducing to about 150 mg/L at 60° C. For these reasons, Grade 304 steel has been largely ignored as a potential substantially permanent cathode plate.

However, Grade 304 steel can be produced in a 2B finish, and the Applicants have surprisingly found that 2B-finished cathode plates made from 304 steel to a thickness of 3.0-3.25 mm are unexpectedly effective when used in the electrowinning of copper.

The Applicants have developed a buffed or finished finish, suitable to produce sufficient operational adherence of an electrowon copper deposit, yet still allow the ready separation of the deposit with now conventional ISA PROCESS® cathode stripping machinery.

The stainless steel may be "buffed" prior to, or after assembly into a cathode configuration. Accordingly, the equipment used in each case will be different. The principal is to utilise one of the commercial tools available for grinding or polishing metals. These may be linishing tools, angle grinders, electric or air driven sanding machines, etc. The choice of buffing media and the speed selection of the device utilised is crucial to obtaining the correct finish of the plating surface of the intended cathode design.

Another foreseeable development within the scope of the present invention is the application of cropped corner cathode technology to the duplex and/or Grade 304 cathode plate/s. Cropped corner cathode technology is disclosed in the Applicants' International Patent Application No. PCT/AU2004/000565. The side periphery and the lower periphery of the cathode blade terminate short of the respective lower and side peripheries with corner edge portions extending between and connecting opposite ends of the bottom edge to the respective side edges.

Further, it is envisaged that the duplex and/or Grade 304 cathode plates of the present invention may be used in conjunction with V-groove technology. The bottom edge and/or corner edge portions of the cathode plate include a groove such as a V-groove to assist in separation of the copper from the cathode blade into two separate sheets.

BRIEF DESCRIPTION OF THE DRAWINGS

A preferred embodiment of the invention will now be described, by way of example only, with reference to the accompanying drawings in which.

PREFERRED EMBODIMENT OF THE INVENTION

Figure 1:
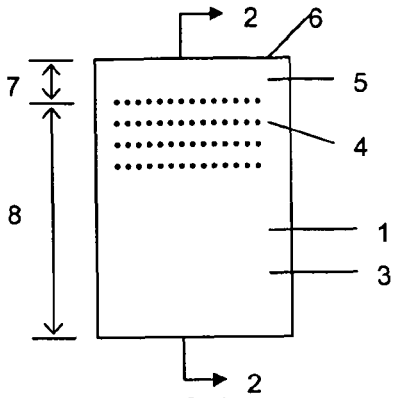
FIG. 1 is a front view of an electrolytic plate according to one embodiment of the present invention, showing a plurality of cavities within the front surface of the plate to increase operational adherence of an electrodeposit.

Referring to the drawings, the electrolytic plate 1 suitable as a substrate for the electrodeposition of a metal 2 is composed of duplex stainless steel or Grade 304 steel.

Where a duplex stainless steel electrolytic plate is required, the appropriate steel is a low-nickel and/or low-molybdenum steel relative to 316L stainless steel and the plate is suitable for use as a starter sheet cathode blank.

Where a Grade 304 steel electrolytic plate is required, the plate is substantially permanent and/or reusable. In a particularly preferred embodiment, the Grade 304 steel is prepared with a 2B finish.

Where either duplex or Grade 304 steel will suffice, the surface/s of the electrolytic plate 1 are modified so as to impart upon the plate "predetermined adhesion characteristics". This term should be taken to mean that the surface 3 of the electrolytic plate 1 upon which electrodeposition of the metal 2 is sought has had its surface roughness modified to produce the adhesion necessary to allow operational adherence of the electrodeposited metal 2 and subsequent handling thereof, the adherence being insufficiently strong to prevent the mechanical separation of the electrodeposition 2 from the modified surface 3.

In a particularly preferred embodiment, the electrolytic plate 1 is a cathode and the electrodeposited metal 2 is electrowon copper.

One means of imparting the sought predetermined adhesion characteristics to the cathode 1 is by way of a buffed surface finish. The buffed surface finish is a plating surface 3 that has had its surface roughness modified to produce the adhesion necessary to allow operational adherence of the electrowon copper deposit 2 and subsequent handling thereof, yet insufficient to prevent the mechanical separation of the electrodeposited copper from the modified surface 3. The buffed finish is defined by a surface roughness $R_a$ typically within the approximate range 0.6 to 2.5 μm, and more preferably within the approximate range 0.6 to 1.2 μm. Devices such as linishing tools, angle grinders, electric or air driven sanding machines, or a combination thereof may apply the buffed finish.

Figure 2:
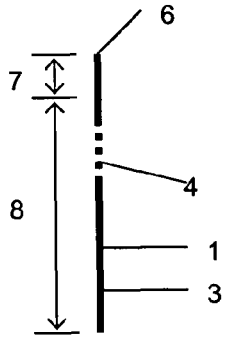
FIG. 2 is a sectional view taken on the line 2-2 of FIG. 1, showing the cavities extending throughout the depth of the electrolytic plate.

Referring specifically to FIGS. 1 and 2 of the accompanying drawings, which outline another preferred embodiment, one or more cavities 4 are formed into the surface 3 of the plate 1, thereby to impart the predetermined adhesion characteristics upon the plate.

The cavities may extend fully through the depth of the plate (FIG. 2), or only partially through the depth of the plate. The cavities 4 are spaced from the upper deposition line 5 of the electrodeposited metal 2 such that metal deposited above the uppermost cavity 4 is relatively easy to remove and metal deposited at or below the level of said uppermost cavity is relatively difficult to remove. The cavities 4 are located substantially 15 to 20 cm from the top 6 of the plate 1, thereby to facilitate the formation of a relatively easily removed upper metal portion 7 and a relatively difficulty removed lower metal portion 8. The electrodeposited metal 2 is removable by a flexion apparatus 9 first wedging between the upper metal portion 7 and the plating surface 3.

Figure 3:
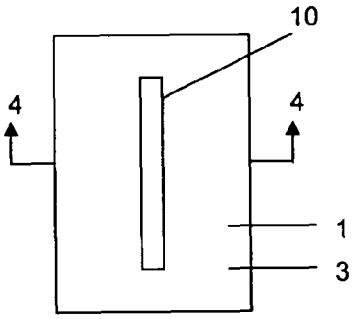
FIG. 3 is a front view of an electrolytic plate according to another embodiment of the present invention, showing a horizontal groove portion extending substantially across the width of the plate.
Figure 4:
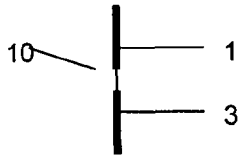
FIG. 4 is a sectional view taken on the line 4-4 of FIG. 3, showing the relative depth to which the groove portion may be formed.

Referring specifically to FIGS. 3 and 4 of the accompanying drawings, which outline another preferred embodiment, one or more groove portions 10 are formed into the surface 3 of the plate 1, thereby to impart the predetermined adhesion characteristics upon the plate. The groove portions may be substantially of any shape or orientation upon the surface of said plate. However, a substantially horizontal groove portion imparts an inherent V-groove limitation upon the plating surface 3.

Figure 5:
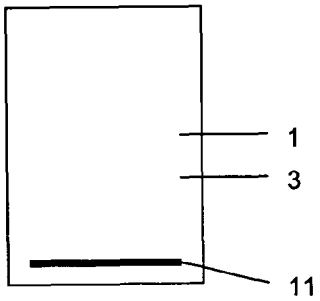
FIG. 5 is a front view of an electrolytic plate according to another embodiment of the present invention, showing a horizontal ledge portion extending substantially across the width of the foot portion of the plate.
Figure 6:
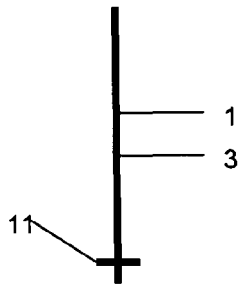
FIG. 6 is a side view of the electrolytic plate shown in FIG. 5, showing the ledge portion extending to both front and back faces of the plate.

Referring specifically to FIGS. 5 and 6 of the accompanying drawings, which outline yet another preferred embodiment, one or more ledge portions 11 are formed into the surface 3 of the plate 1, thereby to impart the predetermined adhesion characteristics upon the plate. The ledge portions may be substantially of any shape or orientation upon the surface of the plate.

In still another preferred embodiment, the predetermined adhesion characteristics are imparted upon the plate surface 3 by electrochemical etching.

Figure 7:
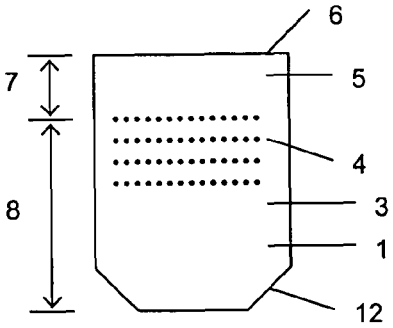
FIG. 7 is a front view of a particularly preferred embodiment of the present invention, incorporating the embodiment shown in FIGS. 1 and 2 with cropped corner technology.

Referring specifically to FIG. 7, which outlines yet another preferred embodiment, the electrolytic plate 1 may incorporate cropped corner 12 technology.

Figure 8:
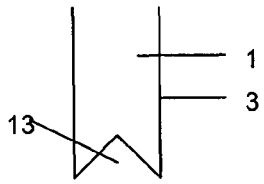
FIG. 8 is an enlarged side view of the foot portion of another particularly preferred embodiment of the present invention, incorporating V-groove technology.

Referring specifically to FIG. 8, which outlines yet another preferred embodiment, the electrolytic plate 1 may incorporate V-groove 13 technology.

In use, the electrowon copper 2 deposited upon the cathode 1 is prevented from disengaging with the plate by one or more surface modification/s in accordance with one or more embodiments of the invention as described above.

There is also provided a method of producing a duplex stainless steel or Grade 304 steel electrolytic plate 1 suitable for the electrodeposition and adherence of metal 2 thereupon, the method including modifying the surface 3 of the plate 1 to obtain a plating surface 3 with modified surface roughness to produce the adhesion necessary to allow operational adherence of an electrolytic metal deposit 2 and subsequent handling thereof, the adherence being insufficiently strong to prevent the mechanical separation of the electrodeposited metal 2 from the modified surface 3.

It will be appreciated that the illustrated invention provides a substantially permanent duplex and/or Grade 304 stainless steel cathode plate suitable for use in electrorefining and/or electrowinning of copper cathodes.

Although the invention has been described with reference to a specific example, it will be appreciated by those skilled in the art that the invention may be embodied in many other forms.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

As used throughout the claims, the term "predetermined adhesion characteristics" should be taken to mean that surface of the electrolytic plate upon which electrodeposition is sought has had its surface roughness modified to produce the adhesion necessary to allow operational adherence of an electrodeposition and subsequent handling thereof, said adherence being insufficiently strong to prevent the mechanical separation of the electrodeposition from the modified surface.

The invention claimed is:

1. An electrolytic plate assembly comprising a plate suitable as a substrate for the electrodeposition of a metal, said plate being at least partially comprised of duplex stainless steel, said plate having at least one surface for electrodeposition of said metal thereupon, said surface having a surface roughness to produce the adhesion necessary to allow operational adherence of an electrodeposit and subsequent handling thereof, said adhesion being insufficiently strong to prevent the mechanical separation of said electrodeposit from the surface and wherein said plate is affixed to a hanger bar adapted to support and transmit current to said plate in an electrolytic bath.

2. An electrolytic plate assembly according to claim 1 wherein said duplex stainless steel is a low-nickel and/or low-molybdenum steel relative to 316L stainless steel.

3. An electrolytic plate assembly according to claim 1 wherein said duplex steel is characterised substantially by a composition comprising approximately: 22-26% Cr; 4-7% Ni; 0-3% Mo; and 0.1-0.3% N.

4. An electrolytic plate assembly according to claim 1 wherein said duplex steel is characterised substantially by a composition comprising approximately: 1.5% Ni; 21.5% Cr; 5% Mn; 0.2% N.

5. A starter sheet cathode blank comprising an electrolytic plate assembly according to claim 1.

6. An electrolytic plate assembly according to claim 1 wherein one or more groove portions are formed into the surface of said plate, thereby to impart upon said plate predetermined adhesion characteristics.

7. An electrolytic plate assembly according to claim 6 wherein said groove portions are-substantially of any shape or orientation upon the surface of said plate.

8. An electrolytic plate assembly according to claim 1 wherein one or more ledge portions are located upon the surface of said plate, thereby to impart upon said plate predetermined adhesion characteristics.

9. An electrolytic plate assembly according to claim 8 wherein said ledge portions are-substantially of any shape or orientation upon the surface of said plate.

10. An electrolytic plate assembly according to claim 1 wherein the surface of said plate is etched, thereby to impart upon said plate predetermined adhesion characteristics.

11. An electrolytic plate assembly according to claim 1 wherein said plate includes cropped corner technology.

12. An electrolytic plate assembly according to claim 1 wherein said plate includes V-groove technology.

13. An electrolytic plate assembly according to claim 1 wherein said duplex steel is characterised substantially by a composition comprising approximately: 21.5-26% Cr; 1.5-7% Ni; 0-3% Mo; and 0.1-0.3% N.

14. An electrolytic plate assembly according to claim 1 wherein said duplex steel comprises approximately 1.5-7% Ni.

15. An electrolytic plate assembly according to claim 1 wherein said duplex steel comprises approximately 21.5-26% Cr.

16. A method for the electrolytic recovery of a metal, comprising:

providing an anode in an electrolytic bath comprising the metal;

providing a cathode in the electrolytic bath, the cathode being a plate as defined according to claim 1;

applying an electric current to the electrolytic bath to dissolve the metal in the electrolytic bath and electrodeposit the metal on the plate; and removing the electrodeposited metal from the plate.

17. The method according to claim 16, wherein the metal is copper.

18. A method of producing a duplex steel electrolytic plate suitable for the electrodeposition and adherence of metal thereupon, said method including:

modifying the surface of a duplex steel plate to obtain a plating surface with modified surface roughness to produce the adhesion necessary to allow operational adherence of an electrolytic metal deposit and subsequent handling thereof, said adherence being insufficiently strong to prevent the mechanical separation of said electrodeposited metal from said modified surface.

19. A duplex steel electrolytic plate when formed by a method according to claim 18.

20. A method according to claim 18, further comprising the step of electrodepositing copper on the modified surface using electrorefining or electrowinning.

21. A method according to claim 18, wherein said modifying step comprises modifying the surface using linishing tools, angle grinders, electric or air driven sanding machines, or a combination thereof.

22. A method according to claim 18, wherein said modifying step comprises etching the surface using electrochemical means.

* * * * *